US006687922B1

(12) United States Patent
Marshall et al.

(10) Patent No.: US 6,687,922 B1
(45) Date of Patent: Feb. 10, 2004

(54) STAINLESS STEEL TOILET RESISTANT TO CORROSION BY SEA WATER

(75) Inventors: Keith D. Marshall, Claremont, CA (US); Carlos J. Galeazzi, Alta Loma, CA (US); Darryl M. Boeltl, Whittier, CA (US)

(73) Assignee: Acorn Engineering Co., City of Industry, CA (US)

( * ) Notice: Subject to any disclaimer, the term of this patent is extended or adjusted under 35 U.S.C. 154(b) by 0 days.

(21) Appl. No.: 10/274,471

(22) Filed: Oct. 21, 2002

(51) Int. Cl.[7] ..... E03D 11/00
(52) U.S. Cl. ..... 4/420; 4/421; 4/DIG. 15
(58) Field of Search ..... 4/420, 421, DIG. 15

(56) References Cited

U.S. PATENT DOCUMENTS 4,454,405 A * 6/1984 Riley ..... 219/61
4,538,307 A * 9/1985 Barnum et al. ..... 4/427
4,559,650 A * 12/1985 Prukner ..... 4/420
5,067,181 A 11/1991 Hafner et al. ..... 4/425
5,142,707 A * 9/1992 Prue ..... 4/222

* cited by examiner

*Primary Examiner*—Henry Bennett
*Assistant Examiner*—Azy Kokabi
(74) *Attorney, Agent, or Firm*—Edgar W. Averill, Jr.

(57) ABSTRACT

A stainless steel toilet resistant to corrosion by sea water. The toilet has a toilet bowl portion which is butt-welded to a rim. The welding is carried out while the inside surface of the weld line is flushed with argon gas. Similarly, a P-trap is butt-welded to an exit opening at the bottom of the bowl portion. A flush ring assembly is supported below the rim member. The result is a toilet which can be operated with sea water without corrosion for a period of years.

8 Claims, 3 Drawing Sheets

FIG. 7
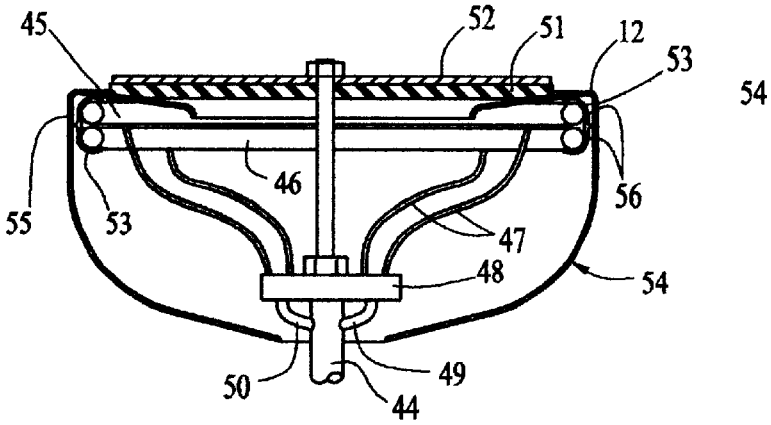
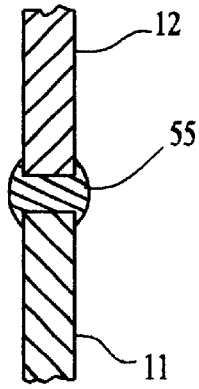
FIG. 10
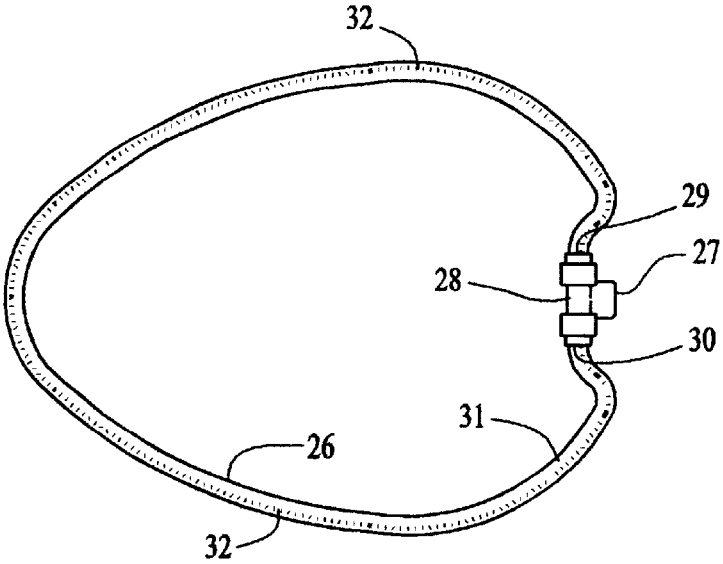
FIG. 9

STAINLESS STEEL TOILET RESISTANT TO CORROSION BY SEA WATER

BACKGROUND OF THE INVENTION

The field of the invention is plumbing fixtures and the invention relates more particularly to toilets and still more particularly, to toilets useful when sea water is used in place of fresh water to flush the toilet.

Stainless steel toilets have been used for many years and are particularly adaptable for use in prisons. An example of a stainless steel toilet is shown in U.S. Pat. No. 5,067,181.

Attempts to use stainless steel toilets utilizing sea water as the flushing medium have in the past been unsuccessful. In spite of the development and use of more corrosion resistant stainless steel, sea water still brought about corrosion at the weld lines and all known efforts to produce a corrosion-free toilet for use with sea water to date have fallen short.

BRIEF SUMMARY OF THE INVENTION

It is an object of the present invention to provide a stainless steel toilet which can operate utilizing sea water as the flushing medium without exhibiting significant corrosion.

The present invention is for a stainless steel toilet resistant to sea water. The toilet comprises a toilet bowl portion having an oval upper ring, sidewalls extending downwardly from the upper ring to a trap outlet ring. A rim member has an oval lower ring of the same size and shape as the oval upper ring of the toilet bowl. The rim member extends upwardly and then inwardly to a seat rest portion, which in turn, extends inwardly and downwardly to an inner terminus edge. The rim member is fabricated from stainless steel and the upper ring of the toilet bowl portion is butt-welded to the oval lower ring of the rim member along a butt-weld line. A P-trap, having an upper ring having the same size and shape as the trap outlet ring of the toilet bowl portion, is fabricated from stainless steel and butt-welded to the trap outlet ring along a butt-weld ring. A flush ring assembly is supported below the rim member and covered by the rim member. The flush ring assembly is fabricated from a small conduit provided with a plurality of water outlet passageways aimed to direct a plurality of water flushing streams against the inner surface of the toilet bowl portion.

The butt-welding is carried out with an argon gas flow maintained on an inner surface of a weld line during the welding step. A process for fabricating the stainless steel toilet is also set forth.

BRIEF DESCRIPTION OF THE DRAWINGS

FIG. 7 is a view of an argon purging assembly ring assembly used during the butt-welding process of the rim to the bowl.

FIG. 9 is a bottom view of the flush rim of the toilet of FIG. 1.

DESCRIPTION OF THE PREFERRED EMBODIMENTS

Figure 1:
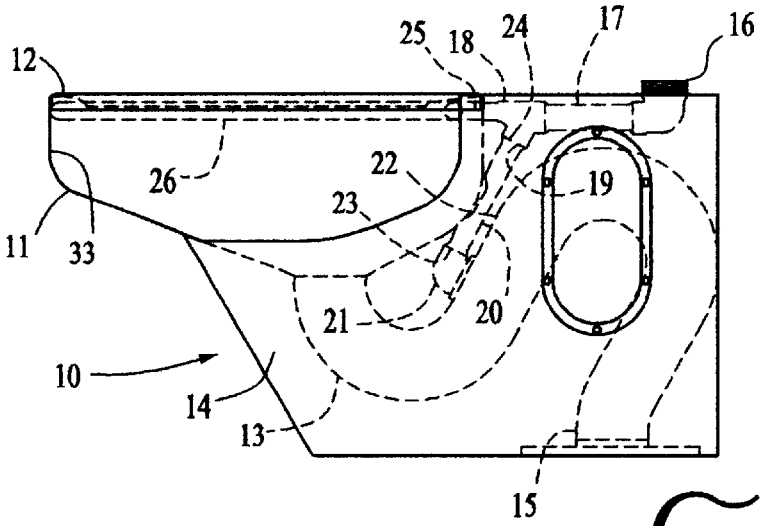
FIG. 1 is a side view of the stainless steel toilet of the present invention.
Figure 2:
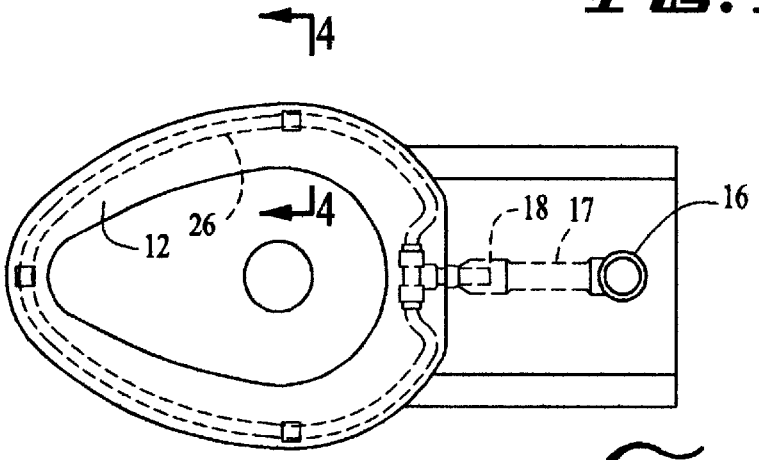
FIG. 2 is a top view thereof.
Figure 3:
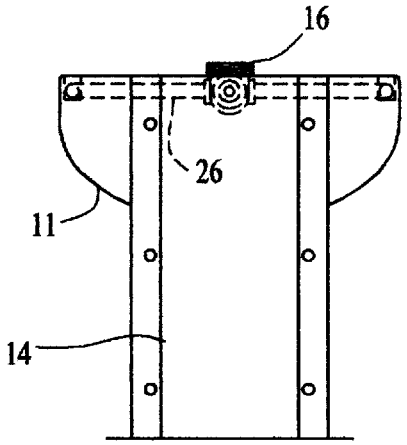
FIG. 3 is a back view thereof.
Figure 5:
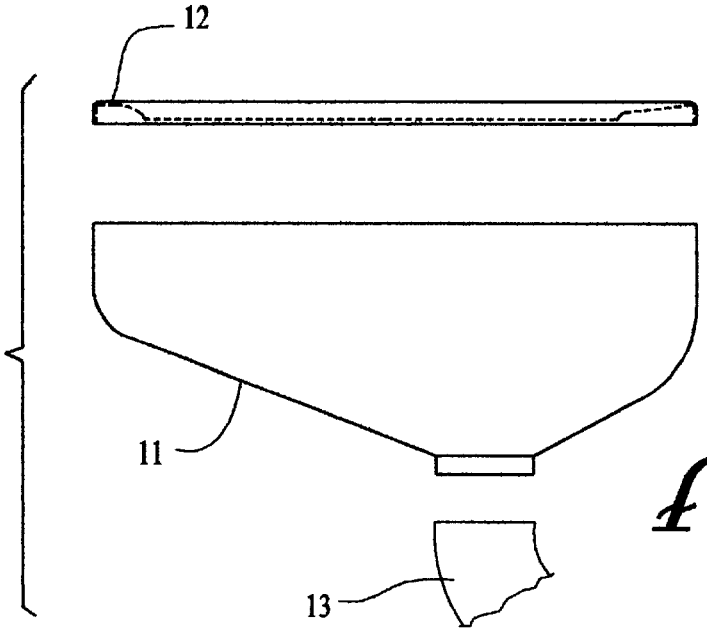
FIG. 5 is an exploded side view showing the rim, bowl, and upper portion of P-trap of the toilet of FIG. 1.

The stainless steel toilet of the present invention is shown in side view in FIG. 1 and indicated generally by reference character 10. The toilet has a toilet bowl portion 11 which is welded to a rim member 12 at its top and to a P-trap 13 at its bottom. These three elements are shown separated in FIG. 5 of the drawings. The bowl is supported by toilet housing 14, which is preferably also fabricated from stainless steel, although it is not normally contacted by sea water. Other methods of supporting the toilet assembly may be substituted for housing 14, depending upon the environment in which the toilet is used.

The P-trap 13 curves-upwardly and then downwardly to an outlet 15. During flushing, sea water enters through elbows 16, then passes through flush inlet tube 17. Flush inlet tube 17 terminates in flushing rim junction box 18, which has two outlets. The larger outlet 19 feeds blowout tube 20. Blowout tube 20 passes sea water into a blowout jet casting 21, which feeds sea water into the interior of P-trap 13 along the upwardly sloped top edge 22 thereof. The top edge of blowout tube 20 is indicated by reference character 24 and the bottom edge by reference character 23.

Figure 4:
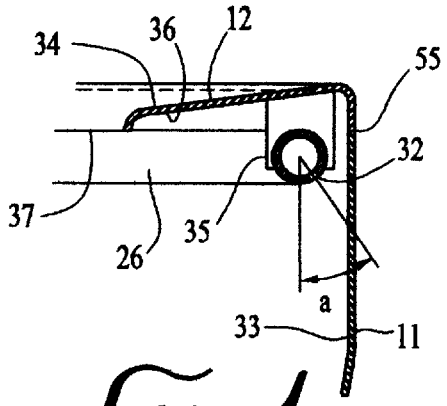
FIG. 4 is an enlarged cross-sectional view taken along line 4—4 of FIG. 2.

The smaller outlet 25 feeds flush ring 26. Flush ring 26 is shown in FIG. 9 of the drawings and has an inlet 27, which feeds sea water into tee 28. Tee 28 has two outlets 29 and 30, which feed a continuous hollow polymeric loop 31. Loop 31 has a plurality of holes 32 which direct water against the inside surface of toilet bowl portion 11. As shown in FIG. 4, the holes 32 are formed so that the sea water is directed at an angle "a" from the vertical. An angle of about 35° provides an appropriate spray pattern for rinsing the inner surface 33 of toilet bowl 11.

Flush ring 26 is preferably held under the upper surface 34 of rim member 12 by a plurality of blocks 35. Blocks 35 are adhered by an adhesive to the under surface 36 of the upper surface 34 of rim member 12. It has been found that a block fabricated from ABS polymer is satisfactory for this purpose. As seen in FIG. 4, the upper edge of flush ring 26 is about even with the lower inner terminus 37 of rim member 12. The toilet of FIG. 1 should be fabricated from a highly corrosion resistant stainless steel such as 300 series austenetic stainless steel.

It was found by numerous experiments that conventional welding techniques used for stainless steel toilets did not prevent corrosion, even when 300 series austenetic stainless steel was used. The corrosion by sea water is especially harmful to the weld lines of the finished toilet. Conventionally, stainless steel toilets are made with an overlap so that the various parts can be easily assembled prior to the welding. Such overlaps, however, resulted in crevice corrosion and it was found that by utilizing butt-welding, crevices are eliminated and a corrosion-free assembly could result. It was also found important to bathe the interior of the weld line with argon, which sanitizes the atmosphere behind the weld and allows for better weld penetration with less heat allowing for less potential of the forming of chromium carbides ergo less potential for corrosion.

Figure 6:
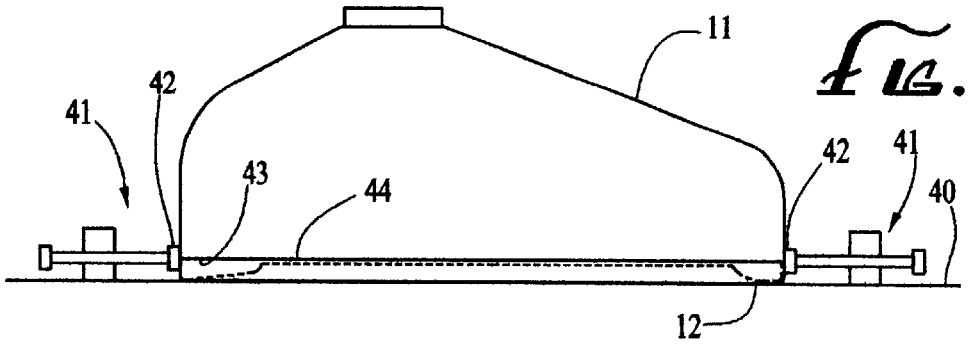
FIG. 6 is a perspective view of the exterior of the bowl and rim of the toilet of FIG. 1.

The welding technique to accomplish a weld which will not corrode under the frequent impingement of sea water is illustrated in FIGS. 6 and 7 of the drawings. In FIG. 6, the toilet bowl portion 11 and the rim member 12 are placed on a table 40 and a series of clamps 41 are adjusted so that their inner faces 42 abut the oval upper ring 43 of toilet bowl portion 11. They also abut the oval lower portion 44 of rim member 12. Sufficient clamps are used so that the two members are aligned in a lower edge to upper edge alignment. It has been found that about 10 clamps are sufficient for this purpose. After the two parts are clamped as shown in FIG. 6, they are tack welded so that they will retain the proper alignment during the final welding process.

Next, the tack welded assembly 54 is inverted to an upright position as shown in FIG. 7 and placed over an argon supply post 44. A pair of argon supply rings 45 and 46 are placed inside the toilet bowl portion 11 through the opening in rim member 12. A series of flexible feed lines 46 are affixed to the argon supply rings and are fed by a manifold 48. Manifold 48 is fed from a source of argon through flexible tubes 49 and 50 to fittings within argon supply posts 44. Next, a gasket 51 and a cover 52 are placed over the opening in rim member 12. A series of clips 53 hold the argon supply rings 45 and 46 adjacent the weld line 55. Next, the interior of the assembly of FIG. 7 is filled with argon and the argon passes outwardly from argon supply rings 45 and 46 through outwardly facing holes so that the inner surface of weld line 55 is bathed in argon. Next, the bowl 11 and rim 12 are carefully welded. Cover 52 has a small hole through its flat upper plate so that air can escape as the argon is filling the interior of the bowl.

Figure 8:
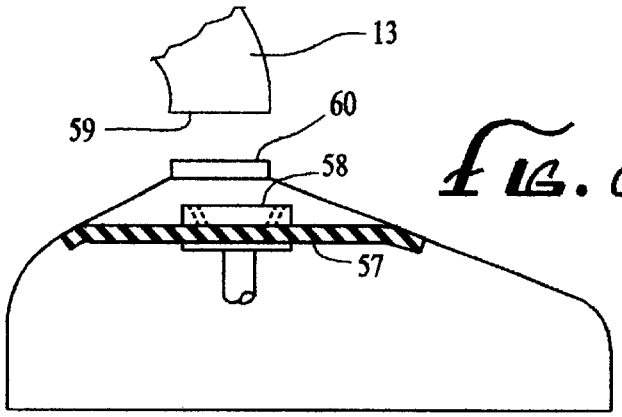
FIG. 8 is a side view showing the argon purging assembly for welding the trap outlet ring to the P-trap.

After completing the upper weld, the P-trap is similarly butt-welded as indicated in FIG. 8 of the drawings. In this case, the cover 52 is removed as is the argon supply assembly and the bowl is again inverted and placed on a rubber flange 57 which surrounds an argon supply plate 58. Supply plate 58 is somewhat like a showerhead having a plurality of holes through which argon passes, filling the space above rubber flange 57 with argon gas. P-trap 13 has a circular end ring 59 which matches the circular exit opening 60 of toilet bowl portion 11. The bowl 11 and P-trap 13 are clamped so that the end ring 59 abuts the circular exit opening 60. After the interior surface is filled with argon, the two end rings are carefully welded together to form a butt-weld ring.

It is also important that the top edge 24 of blowout tube 20 is butt-welded to the flushing rim junction box 18. Similarly, it is important that blowout tube 20 have its bottom edge 23 butt-welded to blowout jet casting 21.

By taking these precautions, the net result is a toilet assembly having welds with no crevices which can withstand the use of sea water over long periods of time without corrosion. The result is a relatively lightweight, as compared to porcelain, toilet assembly. Unlike porcelain to which metal fittings are attached and rust, discoloring the porcelain, the stainless steel remains uncorroded and retains its original appearance.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A stainless steel toilet resistant to corrosion by sea water, said toilet comprising:

a toilet bowl portion having an oval upper ring, side walls extending downwardly from said oval upper ring to a trap outlet ring, said toilet bowl portion being fabricated from stainless steel sheet metal, a rim and seat member having an oval lower ring of the same size and shape as the oval upper ring of said toilet bowl portion and said rim and seat member extending upwardly and then inwardly to a seat portion which, in turn, extends inwardly and downwardly to an inner terminus edge and said rim and seat member being fabricated from stainless steel and said oval upper ring of said toilet bowl portion being butt welded by butt welding to said oval lower ring of said rim and seat member along a butt weld line and wherein said butt welding is carried out by supporting at least one argon supply ring held adjacent an inner surface of said butt weld line, said at least one argon supply ring having outwardly facing openings through which argon escapes and bathes the inner surface of said butt weld line with argon;

a P-trap having an upper ring having the same size and shape as the trap outlet ring of said toilet bowl portion and said P-trap being fabricated from stainless steel and said upper ring of said P-trap being butt welded to said trap outlet ring along a butt weld ring and wherein said butt welding is carried out with argon gas maintained on an inner surface of a weld line during a welding step; and a flush ring assembly supported below said rim and seat member and covered by said ring and seat member, said flush rim assembly being fabricated from a hollow conduit supported independently of said rim and seat member provided with a plurality of water outlet passageways aimed to direct a plurality of water flushing streams against an inner surface of said toilet bowl portion and said flush ring assembly having a sea water inlet opening.

2. The stainless steel toilet of claim 1 wherein said stainless steel is 300 series austenitic stainless steel.

3. The stainless steel toilet of claim 1 wherein said flush ring assembly is supported below said rim and seat member by a plurality of polymeric blocks adhered to an underside of said rim and seat member and to said flush ring assembly.

4. The stainless steel toilet of claim 3 wherein said plurality of water outlet passageways are formed to direct streams of water downwardly at about 35 degrees from the vertical toward an inner surface of said toilet bowl portion.

5. The stainless steel toilet of claim 1 further including a stainless steel flushing rim junction box having a flush ring sea water outlet connected to said flush ring assembly and said flushing ring junction having a sea water opening inlet butt welded to a stainless steel sea water inlet tube and said flushing ring junction having a blowout tube outlet butt welded to the inlet of a blowout tube and said blowout having an outlet butt welded to a blowout jet casting and said blowout jet casting having an outlet welded to an upper side of said P-trap.

6. A process for fabricating a stainless steel toilet impervious to corrosion by sea water comprising:

forming a toilet bowl portion having an oval upper ring, side walls extending downwardly from said oval upper ring to a trap outlet ring, said toilet bowl portion being fabricated from 316 stainless steel;

forming a rim and seat member having an oval lower ring of the same size and shape as the oval upper ring of said toilet bowl portion and said rim and seat member extending upwardly and then inwardly to a seat portion which, in turn, extends inwardly and downwardly to an inner terminus and said rim and seat member being fabricated from 316 stainless steel;

butt welding said oval upper ring of said toilet bowl portion to said oval lower ring of said rim and seat member while maintaining an inner surface of a resulting weld line immersed in argon during said butt welding step and wherein said butt welding is carried out by supporting at least one argon supply ring held adjacent an inner surface of said butt weld line, said at least one argon supply ring having outwardly facing openings through which argon escapes and bathes the inner surface of said butt weld line with argon;

forming a P-trap having an upper ring having the same size and shape as the trap outlet ring of said toilet bowl portion and said P-trap being fabricated from 316 stainless steel; and butt welding said upper ring of said P-trap to said trap outlet ring of said toilet bowl portion while maintaining an inner surface of a resulting weld line immersed in argon during said butt welding step.

7. The process of claim 6 further including the step of affixing a flush ring to the under-surface of said ring and seat member, said flush rim being fabricated from a polymer.

8. The process of claim 6 further including the step of forming a flushing ring junction box having a sea water inlet, a toilet bowl and rim and seat member outlet, a flush ring feed opening and a blowout tube outlet and butt welding said sea water inlet to an outlet of a flush inlet tube, butt welding said toilet bowl and rim and seat member outlet to said toilet bowl and rim and seat member and forming a blowout tube having a blowout tube inlet and a blowout tube outlet and butt welding said blowout tube inlet to said blowout tube outlet of said flushing ring junction box, forming a blowout jet casting having a blowout tube inlet and a P-trap inlet portion and butt welding said blowout tube outlet of said blowout tube to said blowout jet casting blowout tube inlet and butt welding said blowout jet casting P-trap inlet portion to an opening in said P-trap and connecting said flush ring feed opening to an inlet of said flush ring.

* * * * *